US007665163B2

(12) United States Patent
Polevoy et al.

(10) Patent No.: US 7,665,163 B2
(45) **Date of Patent: *Feb. 23, 2010**

(54) T-SHAPED SIDE RAIL FOR BED FRAME

(75) Inventors: Richard S. Polevoy, Teaneck, NJ (US); Paul Eric Carlson, Skaneateles, NY (US); Howard Scott Ryan, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/716,951

(22) Filed: Mar. 12, 2007

(65) Prior Publication Data

US 2007/0157381 A1 Jul. 12, 2007

Related U.S. Application Data

(63) Continuation of application No. 11/129,035, filed on May 13, 2005, now Pat. No. 7,363,664.

(60) Provisional application No. 60/571,135, filed on May 14, 2004.

(51) Int. Cl.
*A47C 19/02* (2006.01)

(52) U.S. Cl. ..... 5/200.1; 5/207

(58) Field of Classification Search ..... 5/200.1, 5/201–208, 310, 286, 288, 296, 905; 72/188, 72/225

See application file for complete search history.

(56) References Cited

U.S. PATENT DOCUMENTS

| | | | | | |
|---|---|---|---|---|---|
| 2,361,729 | A * | 10/1944 | Cords et al. | 72/225 |
| 2,908,918 | A * | 10/1959 | Hopkes, Jr. | 5/200.1 |
| 3,056,974 | A * | 10/1962 | McKay | 5/247 |
| 3,076,979 | A * | 2/1963 | Hopkes, Jr. | 5/246 |
| 3,761,971 | A * | 10/1973 | Behnke | 5/201 |
| 3,914,810 | A * | 10/1975 | Harris | 5/286 |
| 5,623,845 | A * | 4/1997 | Wilde | 72/225 |
| 6,711,765 | B1 * | 3/2004 | Mitchell et al. | 5/202 |
| 2005/0278858 | A1 * | 12/2005 | Polevoy et al. | 5/663 |

* cited by examiner

*Primary Examiner*—Michael Trettel
(74) *Attorney, Agent, or Firm*—Klauber & Jackson L.L.C.

(57) ABSTRACT

A bed frame comprising T shaped side rails provide support for a box spring and mattress. A leg assembly is affixed to the bed frame and is affixed to the side rail and to the cross rails for better strength of connection. The use of T-shaped side rails provides more resistance to twisting and bowing and thereby more resistant to damage a leg or other structural component of the bed frame from moving the bed frame across the floor. The use of the T-shape cross section side rails enables the overall bed frame to support more weight with less deflection than the convention L-shaped side rails. There are also headboard and footboard brackets that take advantage of the greater height of the vertical flange of the side rail to have affixation means, such as rivets, that are further spaced apart to provide a more rigid connection between the brackets and the side rails.

2 Claims, 15 Drawing Sheets

T-SHAPED SIDE RAIL FOR BED FRAME

REFERENCE TO RELATED PATENT APPLICATIONS

The present patent application is a continuation application of U.S. Ser. No. 11/129,035, filed May 13, 2005, now U.S. Pat. No. 7,363,664 and entitled "T-SHAPED SIDE RAILS FOR BED FRAME" and priority to that parent application is hereby claimed.

CROSS-REFERENCE TO RELATED APPLICATIONS

The present application is based upon U.S. Provisional patent application 60/571,135, filed May 14, 2004 and entitled "T-SHAPED SIDE RAILS FOR BED FRAME".

BACKGROUND OF THE INVENTION

The present invention relates to bed frames, and, more particularly, to a bed frame made up of T-shaped side rails.

In general, bed frames are comprised of a pair of side rails and a plurality of cross rails that span between the side rails in order to assemble and complete the bed frame structure. The bed frame, once assembled is adapted to support a box spring and a mattress to make up the bed itself. Normally, therefore, the conventional bed frame assembly is shipped and delivered unassembled for convenience and general transportation and the two side rails are L-shaped steel members.

One type of bed frame is the adjustable width folding frame and, in that bed frame, the cross rails are formed of cross rail members that are pivotally affixed at or near each end of the side rails. For delivery to a customer, the cross rail members are interfitted with and parallel to the side rails for ease of packing and shipment. In the assembly of the bed frame at the location of the customer, therefore, the cross rail members are pivoted about 90 degrees so as to extend generally at a right angle from the side rails and the opposite, free ends of the cross rail members are affixed together at the center area of the bed frame to form cross rails that thus span between each of the side rails. As such, when so assembled and affixed together, the bed frame assumes a generally rectangular configuration to accept the box spring and the mattress.

There is also, normally, a center beam that is positioned so as to be generally parallel to the side rails and which is located at or near the center of the bed frame in order to provide additional support to the overall structure and, of course to the box spring and mattress. The center beam is added to the bed frame to span between the cross rails in order to prevent the further relative movement between the cross rail members as well as to secure the center beam into the bed frame to finalize the task of assembling that bed frame.

Another type of typical bed frame is the fixed width drop together bed frame where the cross members are fixed in length and there are female sockets formed at or near the ends of the side rails that accept male brackets located at the ends of the cross rails and the components simply drop together. The same drop together feature can be used to secure the center beam to the cross rails.

Conventionally, with either of the aforedescribed bed frames, the side rails are constructed of metal angle irons which are L-shaped and there are legs that extend downwardly at each corner of the bed frame from the cross rails to contact the floor in order to support the weight imposed on the bed frame by the presence of the box spring, mattress and, of course, an individual or individuals sleeping in the completed bed.

One of the difficulties, however, with the use of an L-shaped angle iron for the side rails is that the cross sectional profile of the L-shaped angle iron renders the member susceptible to a bending weakness, that is, for example, when the bed is slid along the floor, the leg supporting the side rail is dragged across the underlying floor and can cause the cross rail member and side rail to twist and the twisting action can damage an L-shaped angle iron member that is not particularly resistant to such twisting action. This is especially true when a foot gets caught in an obstruction on the floor or on loose carpet. The situation is exacerbated by the use of off-set casters on the legs since the off-set casters can transfer downward force into side to side force that causes the bed leg to twist.

In addition, there is a bending action that is created by downward force upon the inner horizontal flange of a L-shaped side rail by a cross member resting on or supported by the horizontal flange of the side rail and which tends to twist the L-shape into a downward V-shape and continued force tends to try to flatten that V-shape. Basically the L-shaped side rail angle iron will twist inwardly away from the vertical flange, that is, the distal end of the horizontal flange will twist away from the vertical flange in the downward direction by the load imposed on the horizontal flange of the L-shaped angle iron. Thus, the problem with the use of an L-shaped angle iron for a side rail is not limited to the possible bending caused by a leg being twisted by encountering a snag in a carpet as the leg extending downwardly from a cross rail connected to an L-shaped side rail is moved across that carpet but also simply by the weight of the load imposed on the horizontal flange of the L-shaped side rail to twist the angle iron.

Another difficulty with the use of L-shaped angle irons for the side rails is in the connection of the legs to the side rails in making up the bed frame. That connection needs to be a strong connection for the integrity of the overall bed frame, however, with L-shaped angle irons, the strength of that connection is inherently compromised.

The typical conventional bed frame interfaces with a mattress and box spring by containing the side to side movement within the vertical flanges of the side rail and supports the weight through the horizontal flanges of the L-shaped side rails. The legs thus support the side rails off of the floor and, ideally, the legs would be positioned directly under the side rails at the intersection with the cross rails, giving maximum strength and support. For safety reasons, however, it is also desirable to recess the legs under the bed frame to keep them away from the users feet. Therefore, the legs are typically affixed in some fashion, to the cross rails inboard of the side rails. Such arrangement gives an indirect connection to the side rails and results in a weak connection between the leg and the side rails.

It would thus be advantageous to have side rails that are more resistant to twisting forces so that the bed frame maintains its integrity even when moving across a carpet or under heavy load. It would be further advantageous to have a connection between the legs and the side rails that is more robust and can withstand the twisting forces that are incurred on the connection between the legs and the side rails.

SUMMARY OF THE INVENTION

Now, in accordance with the present invention, there is provided specially configured side rails for a bed frame and an improved means of affixing legs to those side rails to provide a stronger connection between the legs and the side rails.

The side rails are specially configured to have a T-shaped cross section, generally rotated 90 degrees such that there is a vertical flange having a large flat surface of the T-shape facing outwardly from the interior of the bed frame and with the horizontal flange extending inwardly from about the center of the vertical flange. The box spring and mattress are supported on the upward surface of the horizontal flange.

The use of the T-shaped side rail is adaptable for use on either the folding bed frame or the drop together bed frame and in either case, there is considerable greater strength and resistance to twisting and the connection with a leg assembly greatly strengthened. The T-shaped cross section is substantially uniform along the length of the side rail and may be uniform along the full length of the side rail.

As another advantage of the T-shape side rails, there can be a better, more solid, connection, between the side rail and the various brackets that are used to affix the side rails to a headboard and/or footboard. For example, the headboard bracket and footboard bracket can be affixed to the side rails by means of fastening deices, such as rivets, that are more vertically spaced apart and which can be located both above and below the horizontal flange of the T-shaped side rail to improve the rigidity of that connection. One form of the headboard and footboard can be of the hook type where a pair of hooks extend outwardly to become affixed with pins the are transversely located in vertical slots in the headboard or footboard.

Other features of the present side rails and leg assembly affixed thereto will become more apparent in light of the following detailed description of a preferred embodiment thereof and as illustrated in the accompanying drawings.

DETAILED DESCRIPTION OF THE INVENTION

Figure 1:
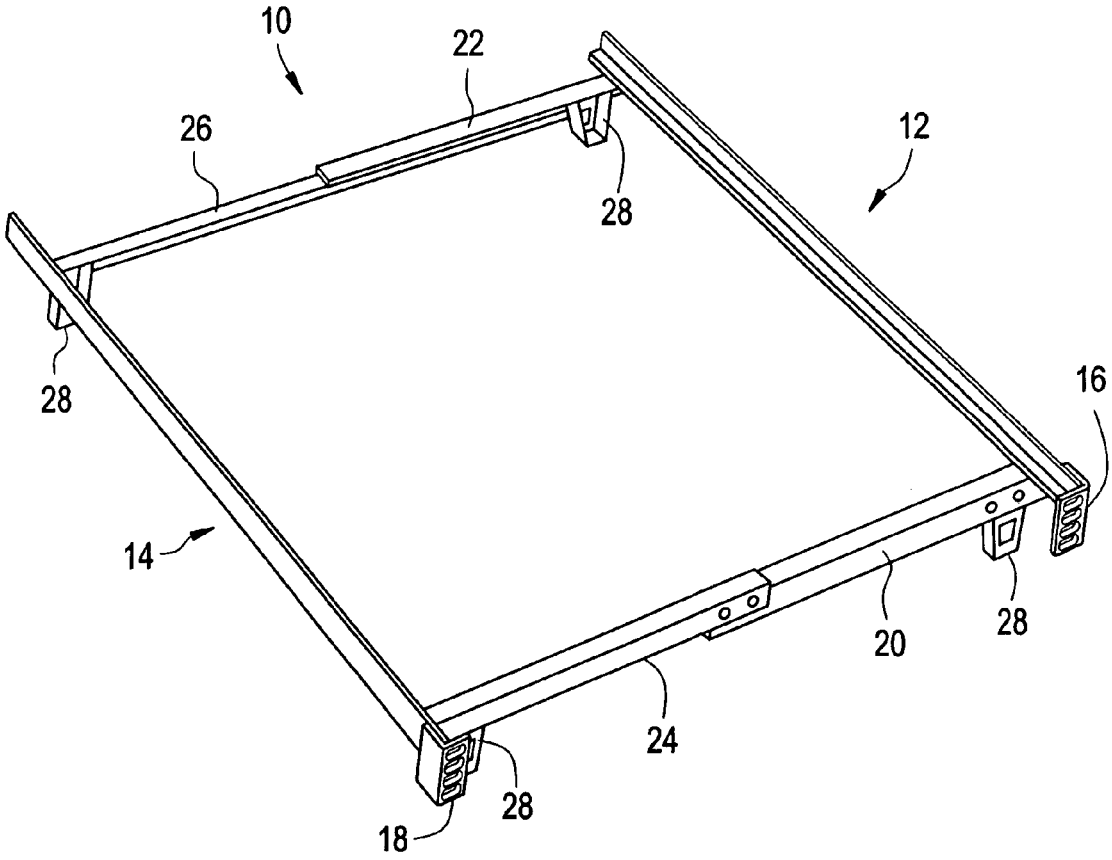
FIG. 1 is a perspective view of a conventional, prior art bed frame utilizing L-shaped side rails.

Referring now to FIG. 1, there is shown a perspective view of a conventional folding bed frame 10. In the Figure, there is a pair of side rails 12, 14 that are normally L-shaped steel members and at one end thereof, there are normally located headboard brackets 16, 18 to aid in the attachment of a headboard to the side rails 12, 14. To make up the bed frame 10, there are also cross rail members 20, 22, 24 and 26 that extend outwardly from side rails 12, 14 at about a right angle. As explained, for the convenience of handling and transportation of the components of bed frame 10, the cross rail members 20, 22, 24, 26 are pivotally mounted to the side rails 12, 14, that is, cross rail members 20 and 22 are pivotally mounted proximate to the ends of side rail 12 while cross rail members 24 and 26 are pivotally affixed proximate to the ends of side rail 14. As an example, therefore, during shipment, the cross rail members 20 and 22 are positioned 90 degrees from the orientation shown in FIG. 1 and rest parallel to and abut against the side rail 12 and, during assembly, the cross rail members 20 and 22 are rotated about 90 degrees to the position as shown.

Legs 28 extend downwardly from each of the cross rail members 20, 22, 24, 26 generally at or near the pivot point between the cross rail member and the side rails 12, 14 and the legs 28 thereby provide the support for the bed frame 10 after the assembly thereof. The legs 28 may be provided with glides or casters (not shown) that contact the floor.

Figure 2:
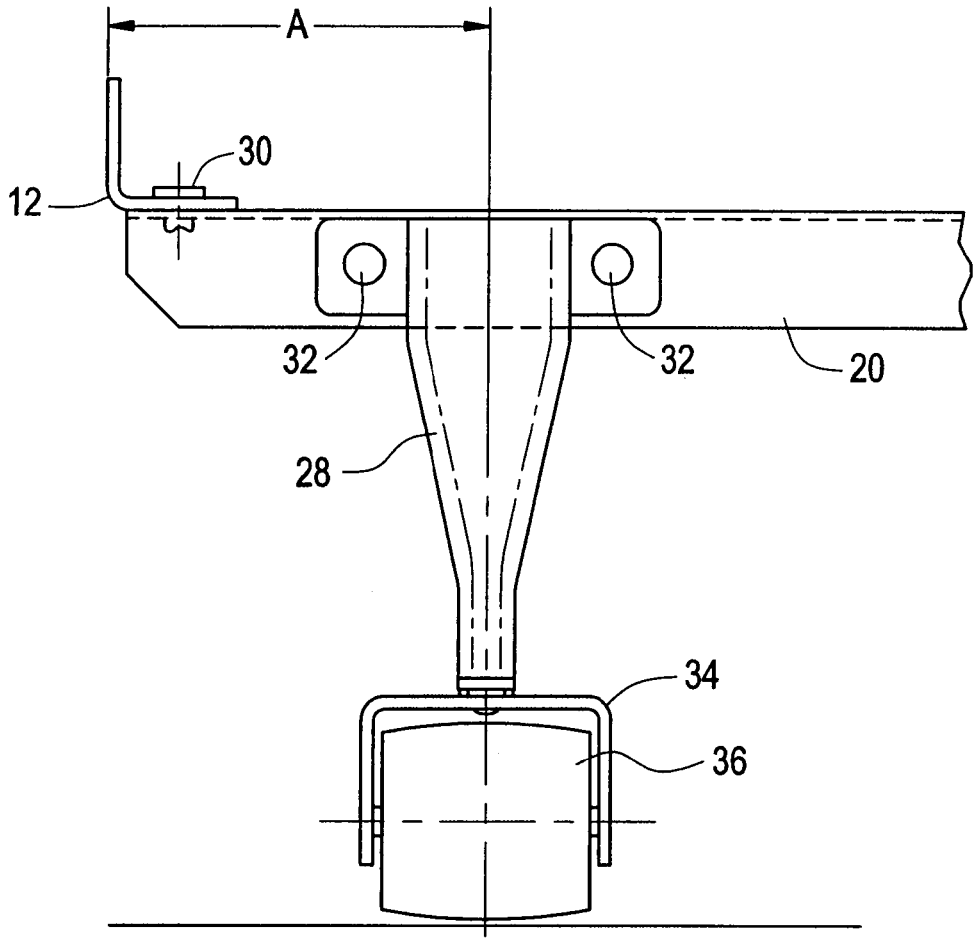
FIG. 2 is a side view of a portion of the bed frame of FIG. 1 illustrating the location of a leg affixed thereto.

Turning now to FIG. 2, there is shown a side view illustrating the location of a leg 28 to a cross rail member 20 and which is typical of the mounting of a leg to any of the other cross rail members of the folding bed frame 10 of FIG. 1. As can be seen, the L-shaped side rail 12 is affixed to the cross rail member 20 by means of a rivet 30 so that the cross rail member 20 can rotate with respect to the side rail 12 in assembling and disassembling the bed frame. The leg 28 is normally affixed to the cross rail member 28 by rivets 32 and has, at its lower end, a caster 34 including a roller 36 that contacts the floor and enables the user to wheel the bed frame 10 from one location to another. The main axis of the leg 28 is displaced away from the side rail 12 a finite distance indicated by the dimension A and that dimension or offset may be about 4.0 inches.

As indicated, ideally the leg 28 would be located directly underneath the side rail 12, however, it is desirable to recess the leg 28 under the bed to keep the leg 28 away from a hazardous location to be hit by a persons foot or ankle so the leg 28 is displaced inwardly away from the side rail 12. Unfortunately, the displacement results in an indirect connection between the leg 28 and the side rail 12 and results in a weak connection between leg 28 and side rail 12.

Figure 3:
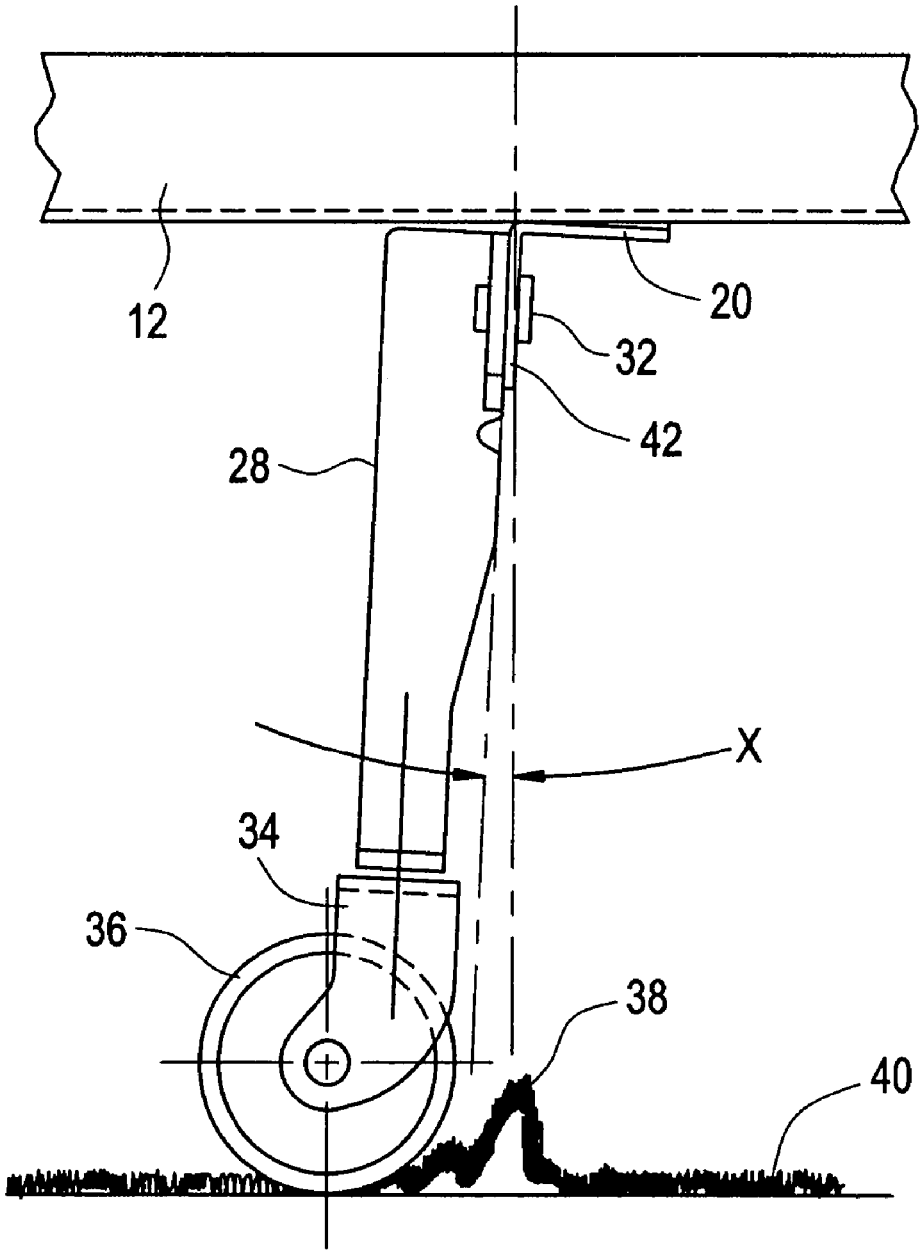
FIG. 3 is an end view of a portion of the bed frame of FIG. 2 illustrating the bending of a leg affixed thereto.

In FIG. 3, there is shown an end view of the leg 28 and which has encountered a snag 38 in a carpet 40 during the movement or rolling of the bed frame (FIG. 1) over that carpet. As such the leg 28 has been bent away from the vertical to an angle X (shown as about 3 degrees) and the vertical flange 42 of the cross rail member 20 has been bent since there is little resistance to that bending and the leg 28 as well as the cross rail member 20 can be permanently damaged.

Figure 4:
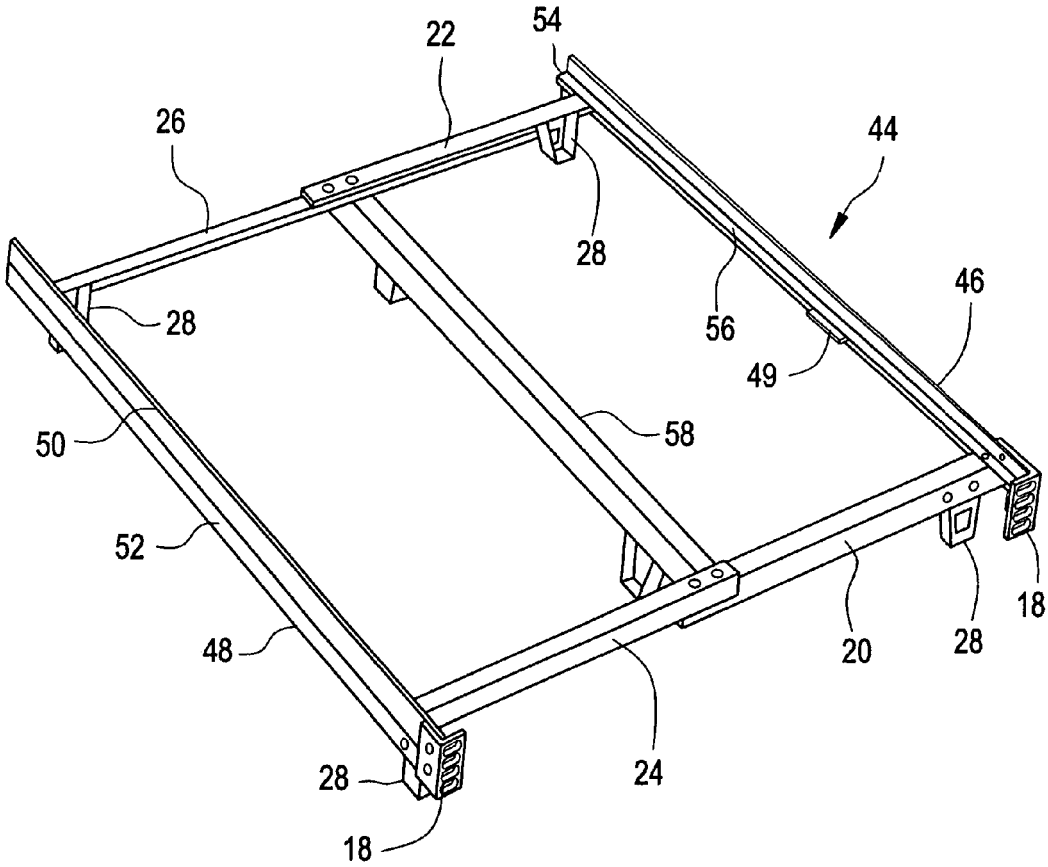
FIG. 4 is a perspective view of an adjustable width folding bed frame having side rails constructed in accordance with the present invention.

Turning now to FIG. 4, there is shown a perspective view of an adjustable width folding bed frame 44 having side rails constructed in accordance with the present invention. In the Fig., like numbers have been used for corresponding components described with respect to FIG. 1. In this embodiment, however, the side rails 46, 48 are different from the side rails 12, 14 of FIG. 1 since the side rails 46, 48 have a T-shaped cross section, rotated 90 degrees from a normal T, instead of the L-shaped cross section of FIG. 1. Thus the T-shaped side rails 46, 48 have the large flat vertical flanges 50 forming exterior surfaces 52 with horizontal flanges 54 extending inwardly from the vertical flanges 50 forming upper surfaces 56 for supporting the box spring and mattress and is located about midway between the outer edges of the vertical flanges 50.

As a further advantageous feature of the use of a T-shaped cross section for the side rails 46, 48, there can be a light producing means 49, that can be used to illuminate the area underneath the completed bed frame 44 to be used as a night light since there is no direct glare or as an aid in locating objects or cleaning underneath the bed. The position of the light producing means 49 is, as can be seen, along the inner surface of the large flat, vertical flange 50 and underneath the horizontal flange 54 so as to be protected from being struck by a passerby and thereby locating the light producing means 49 in a protective environment. The light producing means 49 can be a fluorescent light, track lighting, low voltage strip lighting or any other type of device that is capable of producing light underneath the bed frame 44 and can be used with any bed frame where T-shaped side rails are utilized.

In addition, there is also a center beam 58 that is affixed to and spans the cross rail members 20, 22, 24 and 26. Center beam 58 is generally parallel to the side rails 46, 48. That affixation of the center beam 58 to the cross rail members 20, 22, 24, and 26 may be by bolts and nuts in a conventional manner.

Figure 5:
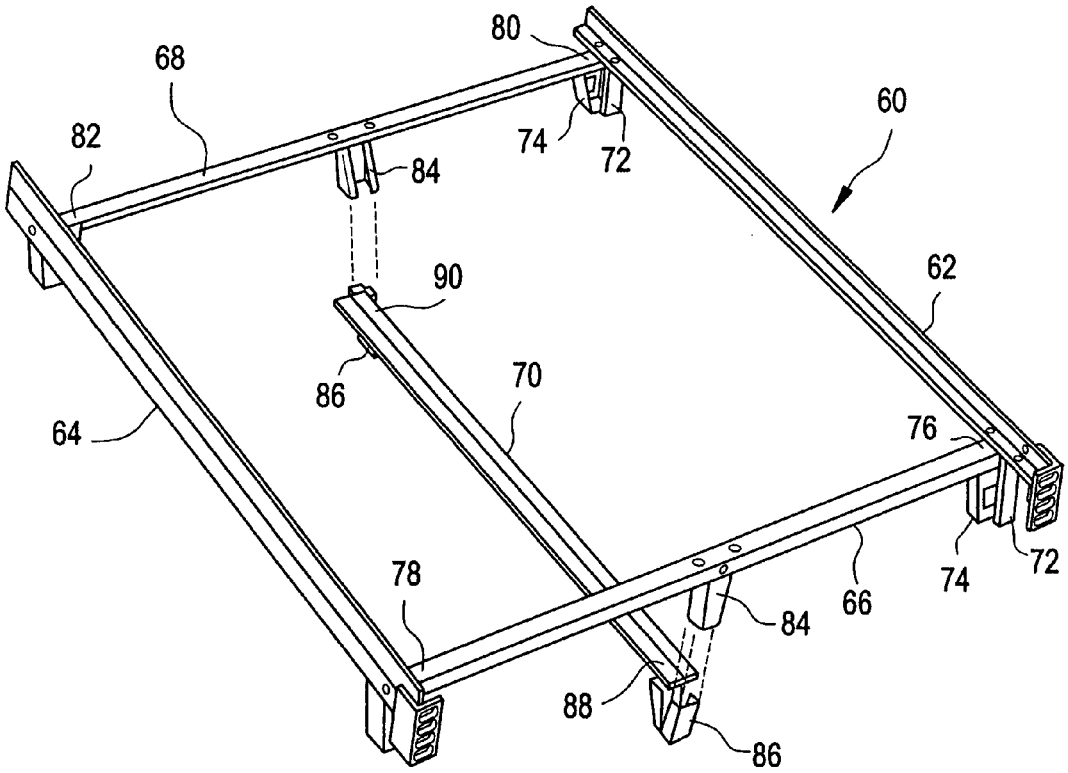
FIG. 5 is a perspective view of a fixed width drop together bed frame having side rails constructed in accordance with the present invention.

Turning now to FIG. 5, there is shown a perspective view of a fixed width drop together bed frame 60 having side rails 62, 64 constructed in accordance with the present invention. In this embodiment, the cross rails 66, 68 are of a fixed length and are affixed to the side rails 62, 64 by means such as female sockets 72 that are angled inwardly toward the interior of the drop together bed frame 60 and which receive correspondingly shaped male flanges 74 located at opposite ends 76, 78 of the cross rail 66 and opposite ends 80, 82 of the cross rail 68. In a similar manner, the center beam 70 is affixed to the cross rails 66, 68 by means of a tapered female sockets 84 that are angled inwardly toward the interior of the drop together bed frame 60 and which receive correspondingly shaped male flanges 86 located at opposite ends 88, 90 of the center beam 70. Thus, as can be seen, the drop together bed frame 60 has the side rails 62, 64 drop into the cross rails 66, 68 and the cross rails 66, 68 drop into the center beam 70 in the assembly of the drop together bed frame 60.

Figure 6:
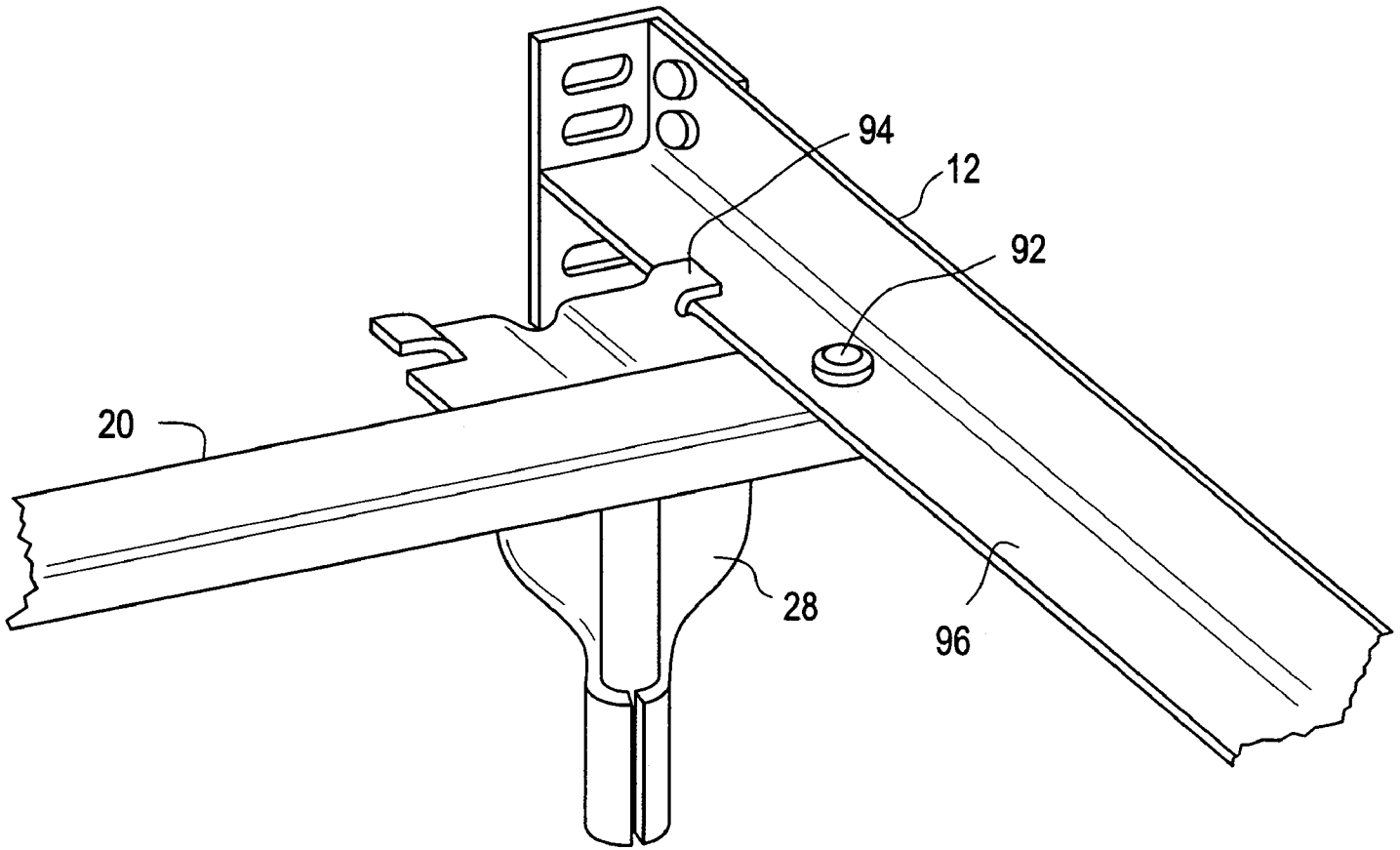
FIG. 6 is a perspective view of a junction of a side rail and a cross rail member of the conventional bed frame of FIG. 1.

In FIG. 6 there is shown a perspective view of a junction of a side rail 12 and a cross rail member 20 of the conventional bed frame 10 shown in FIG. 1. As can be seen, as the cross rail member 20 is rotated to its assembled position as shown in FIG. 6, the cross rail member 20 pivots about the rivet 92 to the point where a tab 94 formed in the leg 28 captures the lower horizontal flange 96 of the L-shaped side rail 12 within the tab 94, thereby holding the cross rail member 20 in its desired position. Such connection does not support the leg 28 in all directions of movement. As can be seen, one of the inherent weaknesses is that the two points of connection between the leg 28 and the side rail 12 are in the same plane, that is, the tab 94 connection to the lower horizontal flange 96 is located in about the same vertical plane as the connection carried out by the rivet 92 and therefore achieve no leverage advantage than if the two junction points were to be separated by a finite vertical distance.

Figure 7:
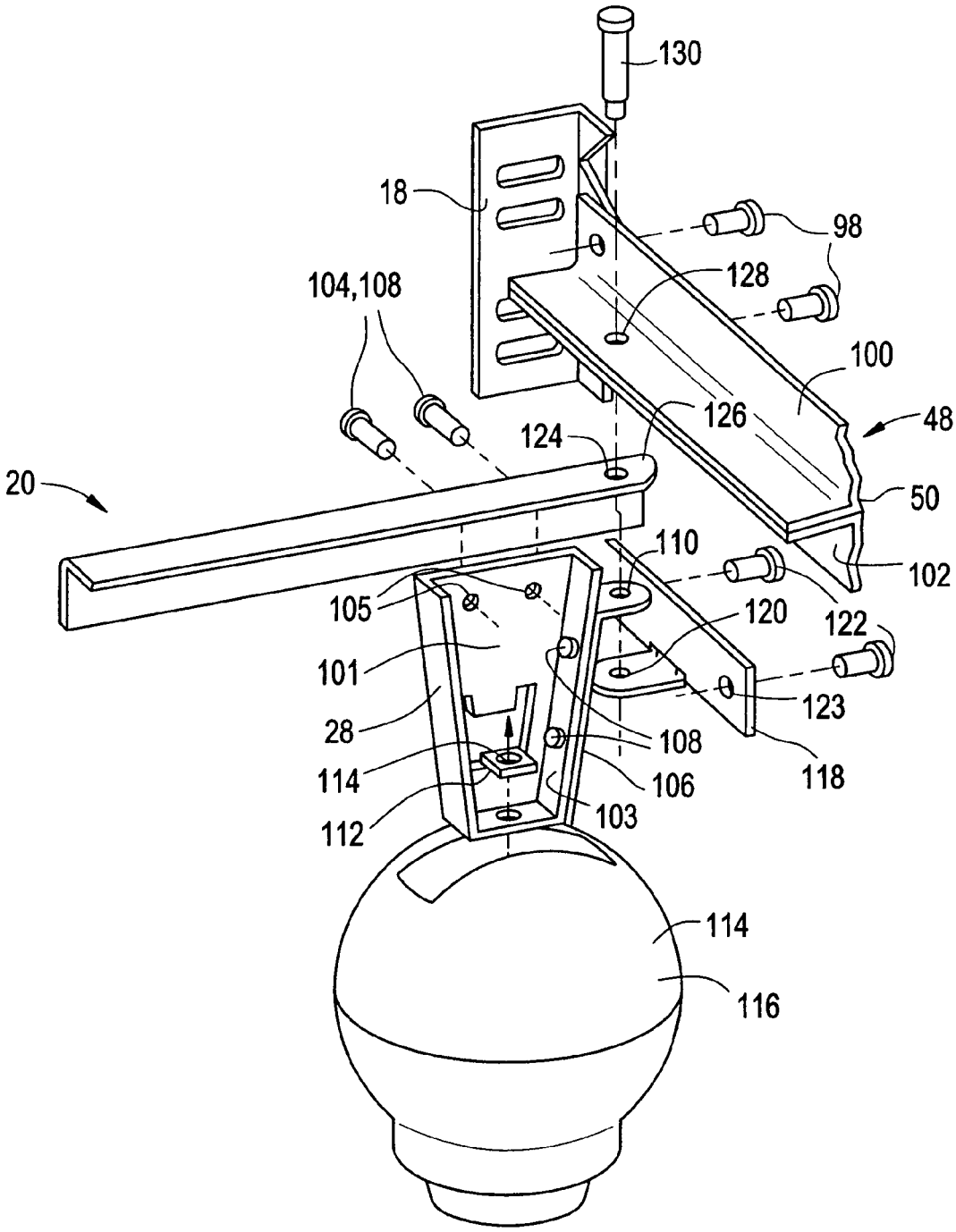
FIG. 7 is an exploded view of a leg of the folding bed frame of the FIG. 4 embodiment affixed to both a cross rail member and a side rail.

Turning to FIG. 7, taken along with FIG. 4, there is shown an exploded view of the leg 28 of the folding bed frame 44 affixed to both a cross rail member 20 and to a side rail 48 and thereby to increase the strength and integrity of the affixation of the leg 28 to those components in the construction of a folding bed frame 44. As shown, the T-shaped side rail 48 can initially create a stronger junction with the headboard bracket 18 since the T-shaped side rail 48 can be affixed by a pair of rivets 98 that pass through both the upper inner surface 100 and lower inner surface 102 of the vertical flange 50 i.e. both above and below the horizontal flange 54 and through corresponding holes in the headboard bracket 18.

The leg 28 basically comprises a main body having a front wall 101 and a side wall 103 that are at or about a right angle with respect to each other. The leg 28 is affixed to the cross rail member 20 by means of a pair of rivets 104 that pass through holes (not shown) in the cross rail member 20 and through a pair of spaced apart holes 105 in the front wall 101 of the leg 28. Leg 28 also has a leg support bracket 106 that is affixed to the leg 28 by rivets 108 that are vertically spaced apart and has an opening 110. The leg 28 also has a caster bracket 112 with an opening 114 that is used to affix a caster or glide to the bottom of the leg 28 and which can be covered by a leg shield 116 in the manner shown and described in U.S. Pat. No. 6,418,578 of Polevoy et al and the disclosure of that patent is hereby incorporated herein in its entirety by reference.

There also is a side rail bracket 118 that is affixed to the lower inner surface 102 of the side rail 48 and which also has a hole 120. Again, the side rail bracket 118 can be affixed to the side rail 48 by means of rivets 122 that are horizontally spaced apart and which pass through holes 123 (only one of which is shown) in the side rail bracket 118. As can also be seen, there is also a hole 124 in the end 126 of the cross rail member 20 that aligns with a corresponding sized hole 128 in the horizontal flange 54 of the side rail 48.

Accordingly, as can now be seen, the leg 28 is affixed to both the cross rail member 20 as well as the side rail 48 and that combined junction is carried out for all of the legs 28 of the folding bed frame 44 shown in FIG. 4. The cross rail member 20 is rotatably affixed to the side rail 48 by means of an elongated rivet 130 that passes through the hole 128 in the horizontal flange 54 of the side rail 48, the hole 124 in the end 126 of the cross rail member 20, the hole 110 in the support flange 106 and the hole 120 in the side rail bracket 118. As such the leg 28 is permanently affixed to the folding bed frame 44 in a strong junction with the leg 28 lower to the floor where there is a mechanical advantage holding the leg 28 stable.

Figure 8:
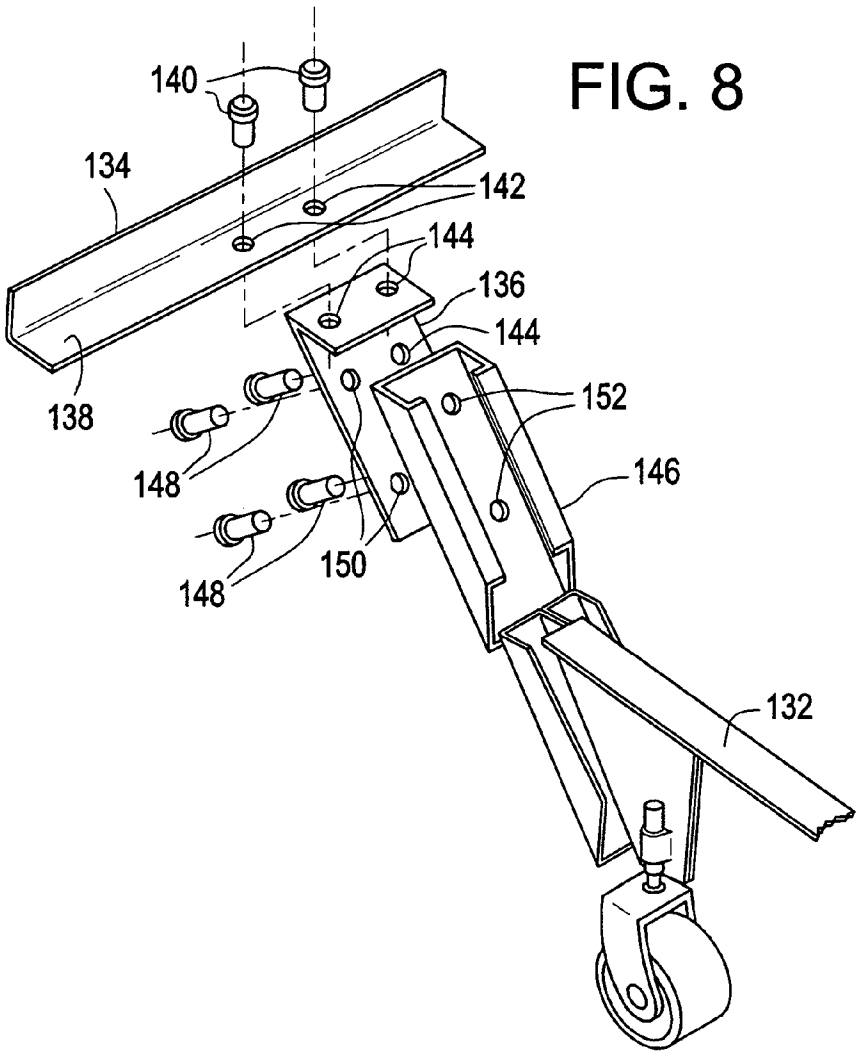
FIG. 8 is an exploded view of a connection between a cross rail and a side rail of a conventional drop together bed frame.

Turning now to FIG. 8, there is shown an exploded view of a connection between a cross rail 132 of a conventional drop together bed frame where the side rail 134 is constructed of the normal L-shaped angle iron. As can be seen, there is required an additional connecting bracket 136 that is affixed to the horizontal flange 138 of the L-shaped side rail 134 by means such as rivets 140 passing through suitable holes 142 in that horizontal flange 138 and holes 144 in the connecting bracket 136 in order to mount the female socket 146 to the side rail 134. The female socket 146 is thereupon affixed to that connecting bracket with rivets 148 passing through holes 150 in the connecting bracket 136 and holes 152 in the female socket 146. Thus, the additional connecting bracket 136 is a necessary component in mounting the female socket 146 in the proper position to receive male flange 154 in joining the cross rail 132 to the side rail 134 in constructing a drop together bed frame.

Figure 9:
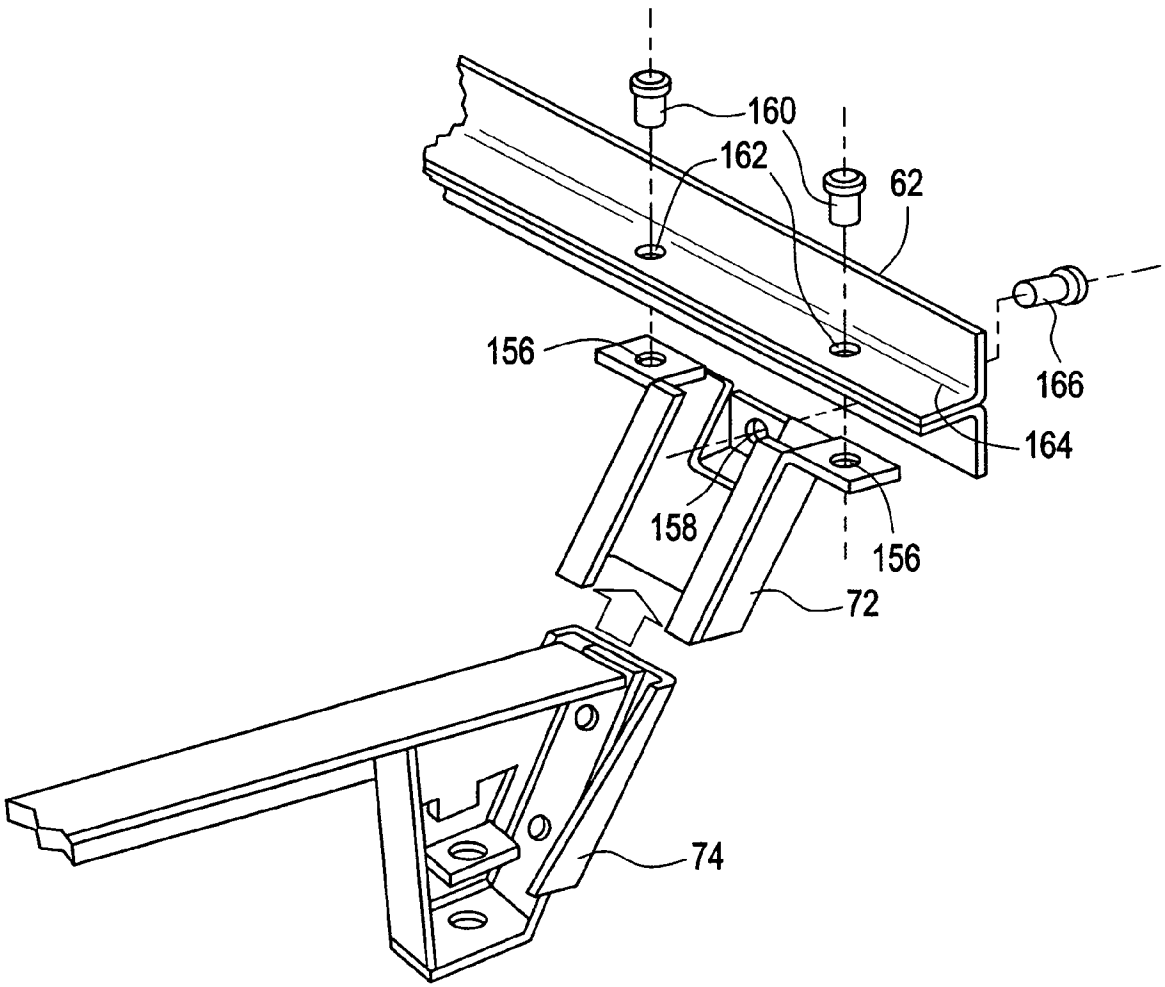
FIG. 9 is an exploded view of a connection between the cross rail and side rail of the FIG. 5 embodiment of the present invention.

Turning to FIG. 9, there is shown an exploded view of a connection between the cross rail 66 and side rail 62 of the FIG. 5 embodiment of the present invention. Taking FIG. 9, along with FIG. 5, therefore, as can be seen, no connecting bracket is required and yet the female socket 72 is firmly and strongly affixed to the T-shaped side rail 62 by the presence of a set of holes 156 in a generally horizontal plane and a hole 158 in a generally vertical plane in the female socket 72. As such, the affixation of the female socket 72 to the side rail 62 is supported in two planes since there are rivets 160 that pass through holes 162 in the horizontal flange 164 of the T-shaped side rail 62 as well as through the holes 156 in the female socket 72 to secure the female socket 72 to the horizontal flange 164. Also, there is a rivet 166 that passes through a hole (not shown) in the vertical flange 168, beneath the horizontal flange 164 and through the hole 158 in the female socket 72 to further secure that female socket 172 to the side rail 62 in two planes about 90 degrees apart. Accordingly, the affixation of the female socket 172 to the side rail 62 is very secure due to the use of the T-shaped side rail 62 of the present invention.

Figure 10A:
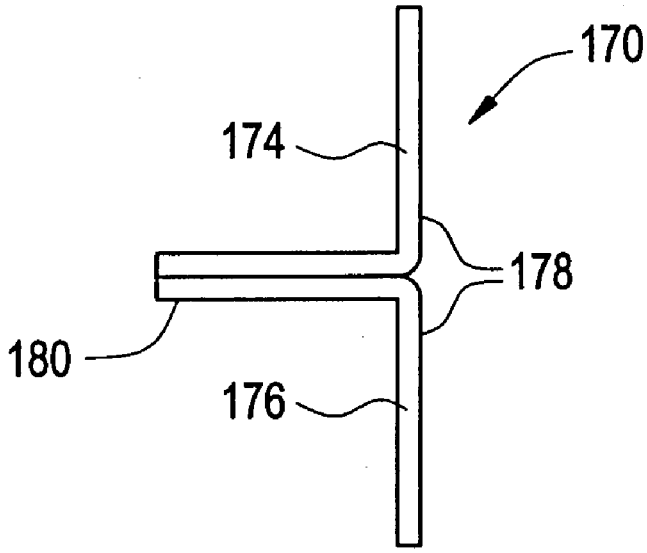
FIGS. 10A and 10B are end views of side rails of the T-shaped cross section of the present invention.
Figure 10B:
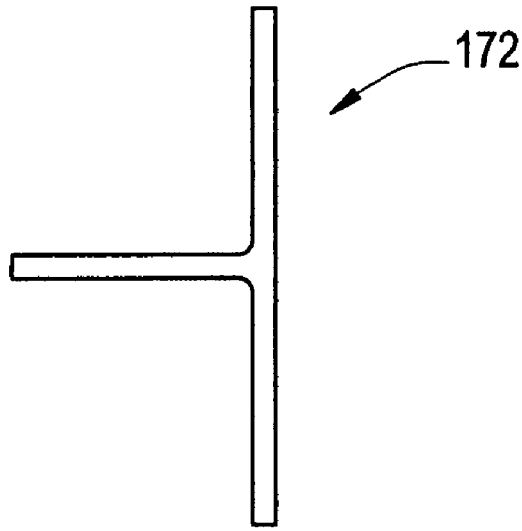

Turning briefly to FIGS. 10A and 10B, there are shown end views of side rails 170 and 172 of the T-shaped cross section of the present invention. In FIG. 10A, the T-shaped side rail 170 is constructed by the securing together of two L-shaped angle irons 174 and 176 by welding, riveting or other means such that the vertical flange 178 is a combination of the vertical flanges of the angle irons 174, 176 and the horizontal flange 180 is an over/under combination of the horizontal flanges of the angle irons 174, 176. In FIG. 10B, the side rail 172 is a one piece rolled construction forming the vertical flange 180 and the horizontal flange 180 extends from about midway between the ends of the vertical flange 178.

Figure 11:
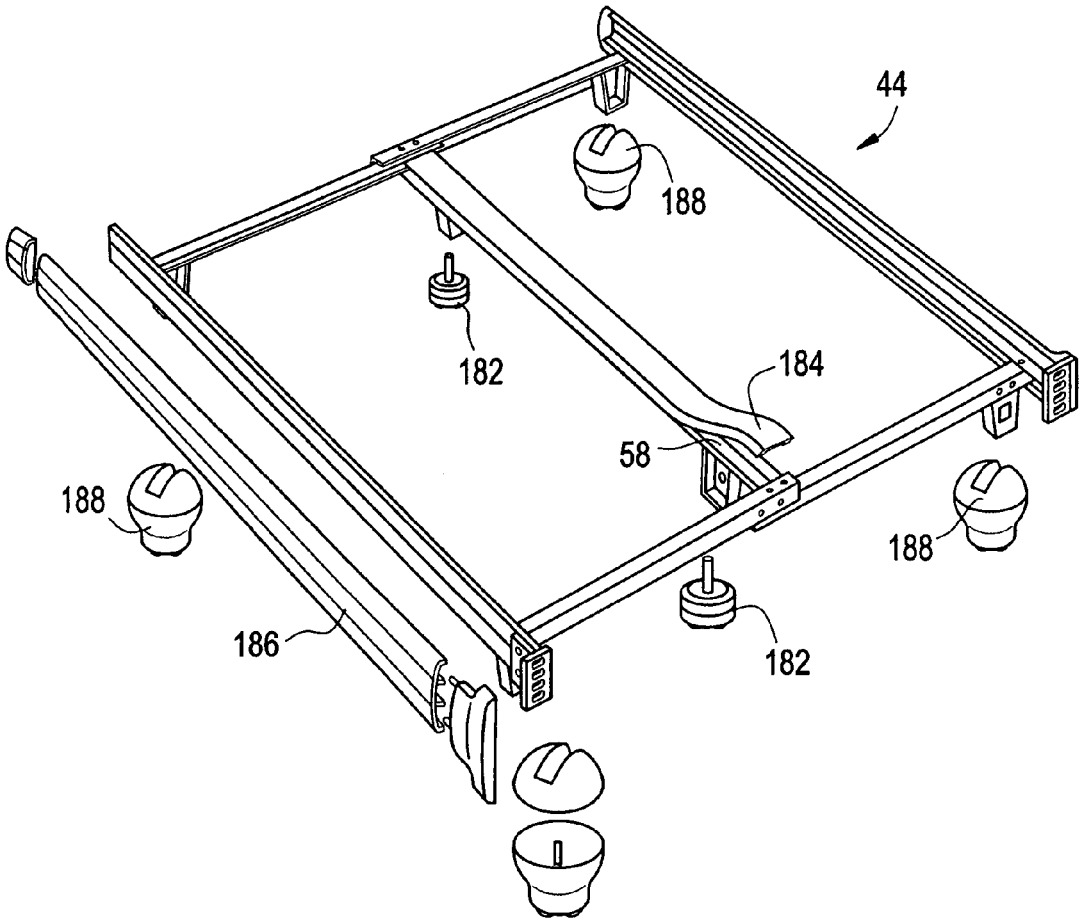
FIG. 11 is a partially exploded view of a bed frame of the present invention illustrating various protective members for assembly thereto.

Turning next to FIG. 11, there is shown a partially exploded view of an adjustable width folding bed frame 44 as shown in FIG. 4 and illustrating the addition of various protective members to improve the appearance of the bed frame as well as provide protection against the inadvertent hitting of the bed frame components by a person where an injury could occur to that person. Thus, there are casters 182 that can be constructed in accordance with the casters shown and described in U.S. Pat. No. 6,568,031 of Polevoy et al, a center beam protective member 184 covering the center beam 58 constructed in accordance with U.S. patent application Ser. No. 09/997,389 of Polevoy et al, a side wall protective member 186 constructed in accordance with U.S. patent application Ser. No. 09/997,389 of Polevoy et al and leg protective members 188 constructed in accordance with U.S. Pat. No. 6,418, 578 of Polevoy et al, all of which patents and pending patent applications being incorporated herein in their entirety by reference.

Figure 12:
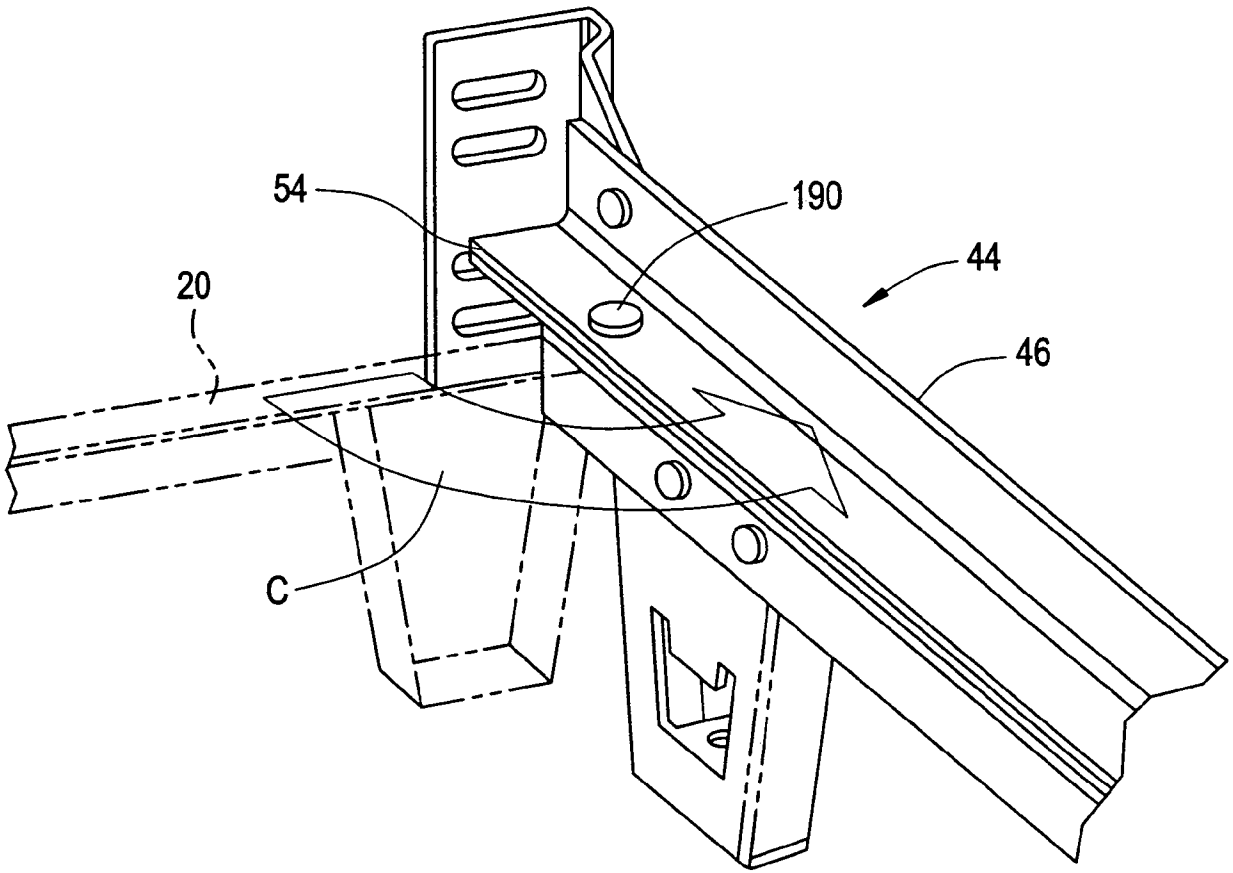
FIG. 12 is a perspective view of a corner of a collapsible bed frame illustrating the folding of a cross rail member with a side rail.

Next, in FIG. 12 there is shown a perspective view of the collapsing of a folding bed frame 44 of the FIG. 4 embodiment where the cross rail member 20 pivots about the rivet 190 in the direction of the arrow C to nest underneath the horizontal flange 54 of the T-shaped side rail 46 to facilitate shipping of the folding bed frame 44.

Figure 13:
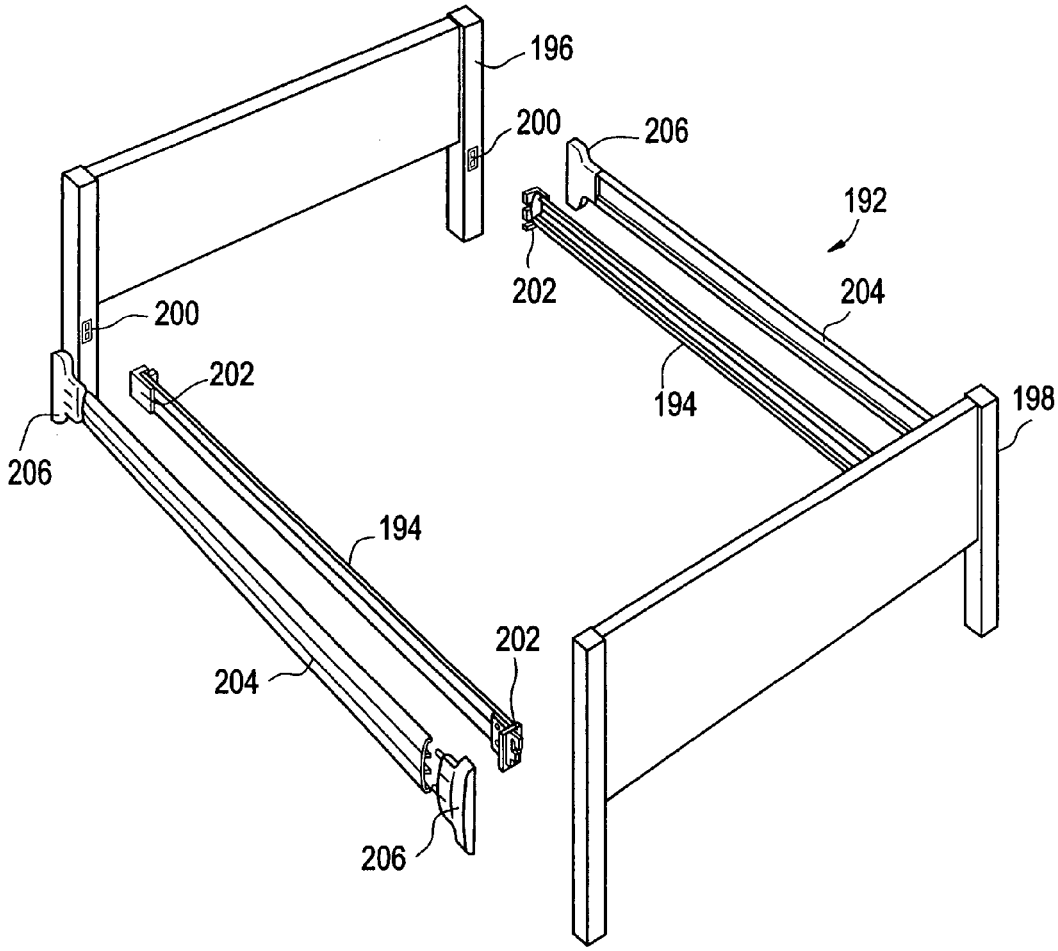
FIG. 13 is an exploded view of a bed frame using hook brackets at the ends of the side rails.

Turning now to FIG. 13, there is shown an exploded view of a bed frame 192 and illustrating the T-shaped side rails 194 that join a headboard 196 and a footboard 198. In the headboard 196, there can also be seen slots 200 within which are conventionally located a pair of pins, vertically spaced apart (not shown) that laterally cross the slots 200 in order to receive a special bracket having hooks that are provided at the ends of side rails. As such, in FIG. 13, hook brackets 202 are shown and which are adapted to be inserted into the slots 200 and hook over the pins in order to join the side rails 194 to the headboard 196 and the footboard 198.

As also can be seen in FIG. 13, there are protective members 204 that are plastic extrusions that are affixed to the side rails 194 to protect a person from injury from hitting the side rails 194 and bracket protective members 206 that cover and protect the sharp edges of the hook brackets 202 to serve the same purpose.

Figure 14A:
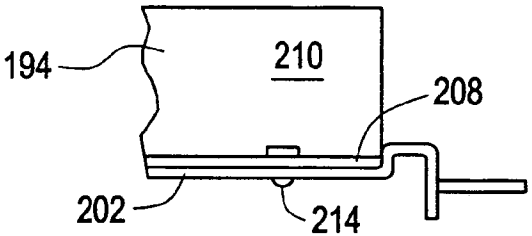
FIGS. 14A, 14B and 14C are, respectively a top view, a side view and an end view of a hook bracket of FIG. 13 affixed to a side rail.
Figure 14B:
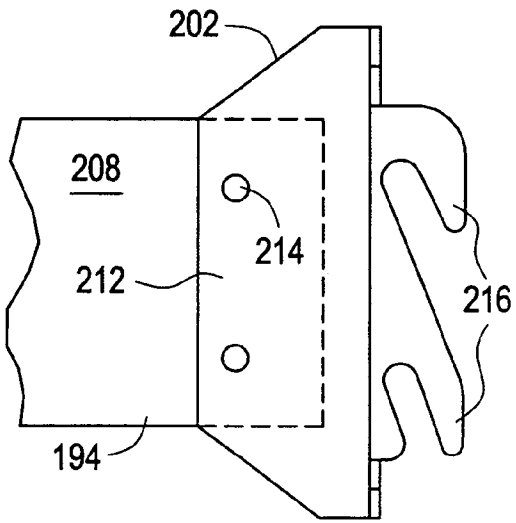
Figure 14C:
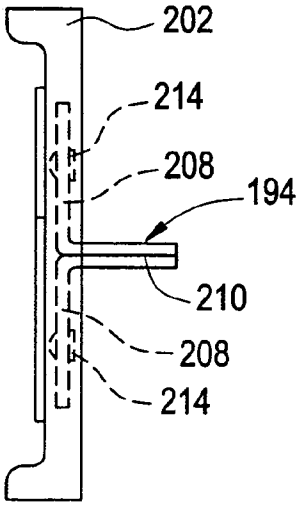

Turning, next to FIGS. 14A, 14B and 14C, there are shown, respectively, a top view, a side view and an end view of a hook bracket 202 affixed to a side rail 194. As can be seen, the side rail 194 has an outer vertical flange 208 and a horizontal flange 210 that extends inwardly from a point about midway between the upper and lower edges of the vertical flange 208 in the manner described with respect to FIG. 5. The hook bracket 202 has a securing flange 212 that is secured to the vertical flange 208 by means such as rivets 214. Thus, by the vertical flange 208 being twice the height as the conventional L-shape angle iron side rails, there can be two rivets 214 sufficiently spaced apart so as to improve the integrity of the junction between the hook bracket 202 and the side rail 194, thereby strengthening the overall junction.

As such with the hook bracket 202 more strongly affixed to the side rail 194 due to the T-shaped configuration of the side rail 194, the hooks 216 can engage the pins and there is less likelihood that the hook bracket 202 will become loose in its connection to the side rail 194.

Figure 15A:
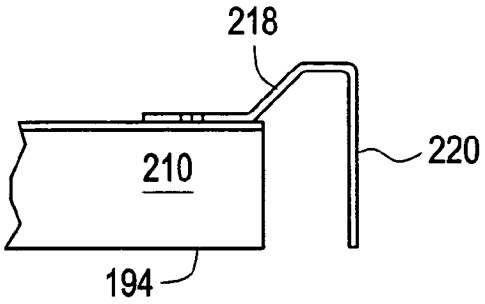
FIGS. 15A, 15B and 15C are, respectively a top view, a side view and an end view of a headboard bracket used with the present invention.
Figure 15B:
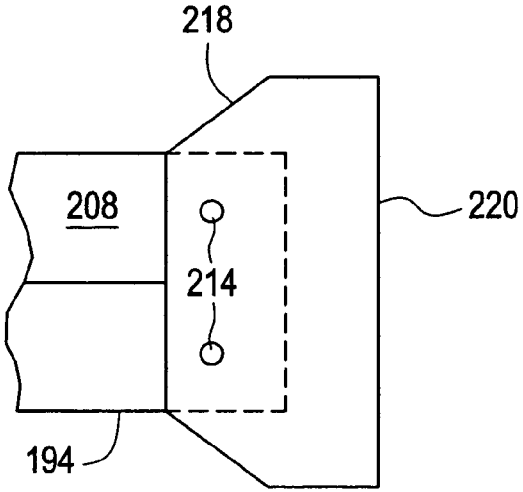
Figure 15C:
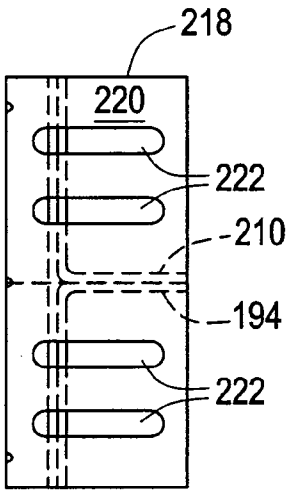

In FIGS. 15A, 15B and 15C, there is shown, respectively, a top view, side view and an end view of a slotted headboard bracket 218 and which can be affixed to the side rail 194 in the same manner as the hook bracket 202 of FIGS. 14A-14C to achieve a junction with added strength and rigidity. As such there are, again, two rivets 214 that are spaced well apart and above and below the location of the horizontal flange 210. The forward face 220 of the headboard bracket 218 has a plurality of elongated slots 222 that are provided in order to affix the headboard bracket 218 to a headboard by means such as screws.

With the use of the T-shaped side rail therefore, the present invention allows the current metal bed frame to have a bracket to attach to a headboard for decorative purposes that is solid and well supported. This creates the impression of a finished bed like a complete wood or metal bed where the side rails are supported by the legs of a headboard and footboard. With this type of bed frame, however, that is a metal Hollywood style bed frame that is, the bed frame is self supporting but there is no footboard.

The result is a headboard that is not weight bearing and is suspended from the side rails on brackets. Due to the height of a typical headboard, stability is often an issue. The current headboard brackets 218 are mounted to the vertical flange 208 of the side rail 194. The L-shaped, conventional, side rail, however, provides relatively a small area for a junction with a headboard bracket and typically the rivets are assembled side to side along the vertical flange.

With the present invention, however, using a T-shape cross section of side rail 194, the side rail 194 and headboard are assembled with rivets 214 vertically aligned with significantly more separation and which provides significantly more stability at the headboard top. The double vertical flange of the present side rail is the geometry that allows for that advantage. Additionally, the intermediate horizontal flange stabilizes the vertical flange allowing for the superior rigidity.

While the present invention has been set forth in terms of a specific embodiment of embodiments, it will be understood that the present T-shaped side rail bed frame herein disclosed may be modified or altered by those skilled in the art to other configurations. Accordingly, the invention is to be broadly construed and limited only by the scope and spirit of the claims appended hereto.

We claim:

1. A bed frame assembly comprising:

a pair of parallel spaced apart side rails and at least one cross member spanning between the side rails, at least one of the side rails having a T-shaped cross section, the T-shaped cross section comprising a vertical flange having upper and lower edges and a horizontal flange extending outwardly from the vertical flange at about midway between the upper and lower edges of the vertical flange, the horizontal flange providing a surface for supporting a box spring and mattress wherein the at least one T-shaped side rail comprises two L-shaped angle iron members affixed together.

2. A bed frame assembly comprising:

a pair of parallel spaced apart side rails and at least one cross member spanning between the side rails, at least one of the side rails having a T-shaped cross section providing a surface for supporting a box spring and mattress, wherein at least one T-shaped side rail comprises two L-shaped angel iron members affixed together.

* * * * *